United States Patent [19]

Danner

[11] 4,248,546

[45] Feb. 3, 1981

[54] MANHOLE CEILING TENT

[76] Inventor: Donald J. Danner, 64 Rachelle Dr., Cheektowaga, N.Y. 14227

[21] Appl. No.: 52,397

[22] Filed: Jun. 27, 1979

[51] Int. Cl.[3] ..... E02D 29/14

[52] U.S. Cl. ..... 404/25; 135/5 R; 52/19

[58] Field of Search ..... 404/25, 26; 52/19, 20; 160/188; 135/5

[56] References Cited

U.S. PATENT DOCUMENTS

| | | | |
|---|---|---|---|
| 3,009,166 | 11/1961 | Sears | 135/5 R |
| 3,048,183 | 8/1962 | Grundseth | 135/5 R |
| 3,489,156 | 1/1970 | Otto | 135/5 R |
| 3,581,436 | 6/1971 | Basiger | 135/5 R |
| 3,712,009 | 1/1973 | Campagna | 404/25 X |
| 3,865,429 | 2/1975 | Barker | 135/5 R X |

*Primary Examiner*—Nile C. Byers, Jr.
*Attorney, Agent, or Firm*—Joseph P. Gastel

[57] ABSTRACT

A manhole tent including a substantially planar sheet-like portion for placement in contiguous relationship to the ceiling of a manhole, an opening in the sheet-like portion, a chimney attached to the sheet-like portion and leading to the opening for permitting ingress and egress of personnel into a manhole, and grommets in the edges of the sheet-like portion for receiving ties for securing the manhole tent in position.

12 Claims, 7 Drawing Figures

MANHOLE CEILING TENT

BACKGROUND OF THE INVENTION

The present invention relates to a manhole ceiling tent for placement in contiguous relationship to the ceiling of a manhole to protect workers therein from falling debris and liquid.

By way of background, underground telephone cables are in common usage. At spaced intervals along underground cable routes, there are manholes through which the underground cables extend. These manholes permit workers to have access to the cables for splicing and repair purposes. The manholes are generally entered through a manhole chimney after the manhole cover has been removed, and the manhole itself consists of a chamber which houses the cables. Generally, the manhole floor, walls and ceiling are made of concrete. Above the ceiling there is usually a road bed which underlies the pavement. However, in certain situations, the manhole may be located under bare earth. Under certain circumstances, usually rain, the ceiling of the manhole may leak, and thus workers therein may be harassed by dripping water, or if the leak is big enough, they may be harassed by water flowing in a stream from the ceiling. The foregoing leakage not only makes working in the manhole uncomfortable, but many times makes it impossible for the worker to do a proper job, especially when he is hurrying to get the job done. If the leakage is sufficiently bad, the workers will not enter the manhole to perform their work while the leaking occurs and thus there is an economic loss to the telephone company. In this respect, it should be noted that the leaking is not only limited to periods of rain, but it continues on until drainage through the ceiling has been completed. In addition, workers are harassed by debris, insects, reptiles and other foreign bodies falling from the manhole ceiling.

SUMMARY OF THE INVENTION

It is the object of the present invention to provide a manhole ceiling tent which can be installed in contiguous relationship to a manhole ceiling for the purpose of catching falling debris and water and other foreign material which may drop from the ceiling, to thereby protect workers in the manhole therefrom and thus permit the workers to work in the manhole under conditions which might otherwise be intolerable. Other objects and attendant advantages of the present invention will readily be perceived hereafter.

The present invention relates to a manhole tent comprising sheet-like means for placement in contigous relationship to the ceiling of a manhole, and opening means in said sheet-like means for permitting ingress and egress of said personnel. In its preferred form, the manhole tent also includes attachment means for suspending said manhole tent in said contiguous relationship to said ceiling, and it also includes a chimney attached to said sheet-like means leading to said opening means. The various aspects of the present invention will be more fully understood when the following portions of the specification are read in conjunction with the accompanying drawings wherein:

DESCRIPTION OF THE PREFERRED EMBODIMENTS

Figure 1:
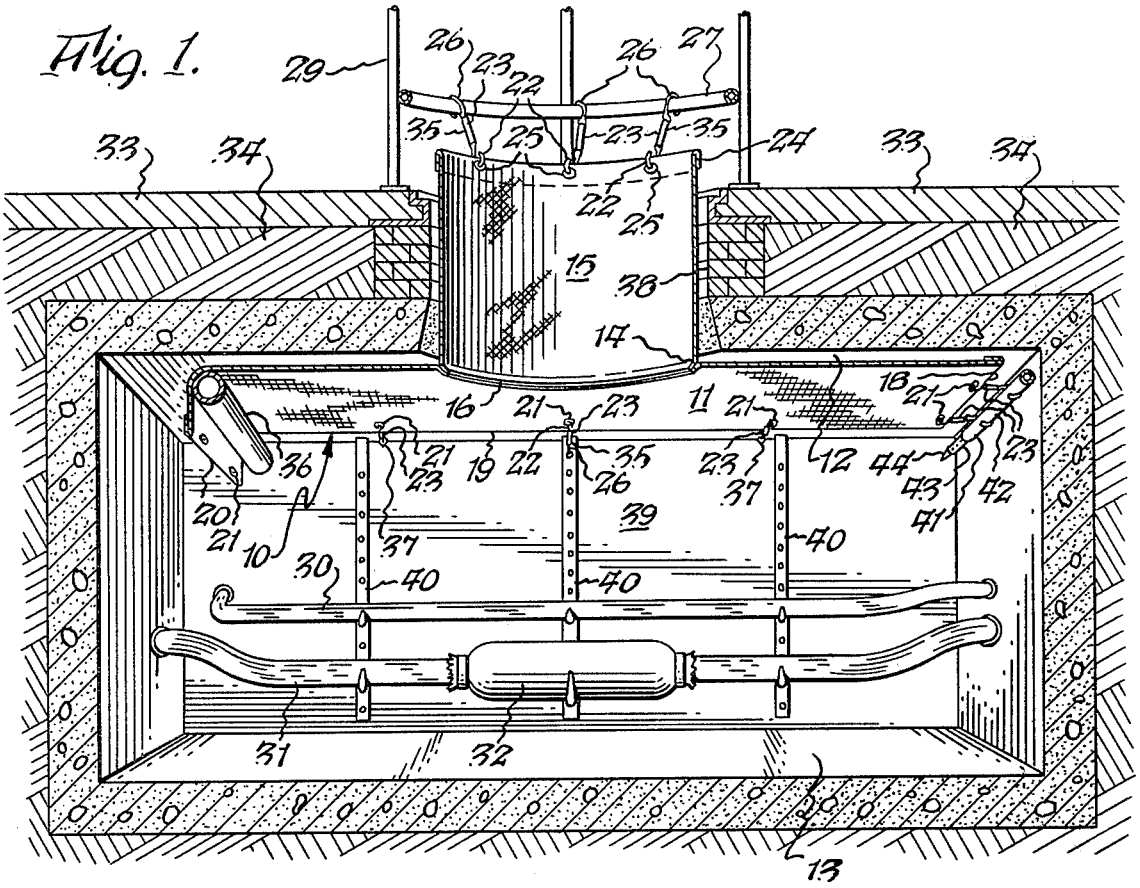
FIG. 1 is a fragmentary cross sectional view of the manhole ceiling tent of the present invention positioned in contiguous relationship to the ceiling of a manhole and showing various ways of securing the tent in position.

The manhole tent 10 of the present invention includes a sheet-like portion 11 which is fabricated from a suitable material, such as canvas, plastic, or the like. While sheet-like portion 11 is shown as being substantially planar, it will be appreciated that it need not be exactly planar, but it may assume any other configuration which will achieve the intended object of the tent, namely, to prevent material which falls from manhole ceiling 12 from dropping onto workers within manhole 13. Sheet-like portion 11 includes an opening 14 through which workers can enter and leave manhole 13, and a tent chimney 15, which can be fabricated from the same material as sheet-like member 11, is attached to the edges of opening 14 by means of a suitable seam 16, which can be sewn, fused, glued or formed in any other suitable manner.

The edge portions 17, 18, 19 and 20 of sheet-like member 11 can be folded over to provide a hem, as shown, and grommets 21 are installed in the hem for the purpose of receiving hooks, such as 22, which are parts of tie members 23 (FIG. 4), for securing the tent in position within the manhole. A hem 24 is formed at the upper edge of chimney 15 and a plurality of spaced grommets 25 are installed in the hem for receiving hooks, such as 22 of tie members 23, the hooks 26 of tie members 23 being attached to rung 27 of a metal frame 29 which may be mounted outside of the manhole in the conventional manner. The manhole frame 29, which forms no part of the present invention, may be of the type shown in U.S. Pat. No. 3,525,290, or it may be of any other suitable type, provided that it has structure thereon onto which tie members 23 may be fastened.

As expressed briefly above, the manhole 13 houses telephone cables, such as 30 and 31, with the latter having a splice 32 therein. Whenever personnel work in manhole 13, they are often harassed by foreign matter dropping from ceiling 12. The foreign matter can be debris which works loose from the ceiling, but more often it is dripping water which passes through road surface 33, road fill 34, and manhole ceiling 12. The water may also drain down the sides of manhole chimney 38. The water may drip for extended periods of time, namely, during periods of rain and for a long time thereafter until water in road 33 and fill 34 has completed its drainage. If the dripping is severe enough, personnel cannot work within manhole 13, as the dripping not only constitutes a source of annoyance and harassment, but also can constitute a health menace and can also result in an inferior job being performed on the cable within the manhole because of the fact that the personnel inherently hurry to finish the job so that they can get out of the annoying environment. Alternatively, if the conditions become bad enough, personnel will not work in a dripping manhole, and consequently there is a large economic labor loss to the telephone company because the workers will generally merely wait outside of the manhole until the dripping within the manhole terminates.

The manhole ceiling tent of the present invention permits personnel to work within a manhole because it obviates the above-described harassment caused by falling debris and liquid from the manhole ceiling 12. In this respect, in the event that manhole ceiling 12 is of the type from which debris can fall or if liquid is dripping therefrom, the ceiling tent 10 is positioned within the manhole in contiguous relationship to ceiling 12 and manhole chimney 38 in the manner shown in FIG. 1 so that anything falling on the outside of tent chimney 15 or on the top of portion 11 cannot reach a worker under the tent. In this respect, the sheet-like portion 11 is suitably attached in contiguous relationship to the ceiling and the chimney 15 is secured to frame 29 as shown. The sequence of installation may be as follows. First, the sheet-like portion 11 is passed through manhole chimney 38 and tie hooks 22 are passed through grommets 25 to secure tent chimney 15 in position. Thereafter, a ladder (not shown) is passed through tent chimney 15 and a worker descends through tent chimney 15 into manhole 13 and thereafter fastens the edge portions of sheet-like member 11 so that it is positioned in contiguous relationship to ceiling 12. Alternatively, a worker may descend into the manhole through manhole chimney 38 and thereafter the sheet-like member 11 may be inserted through chimney 38 and the edges thereof may be fastened in position after a worker on the outside of the manhole attaches tent chimney 15 in position. The tent chimney 15 provides ventilation to the manhole, in addition to providing the protection described above, and in addition to permitting entry and egress of workers relative to the manhole.

There are various ways of attaching ceiling tent 10 in its operative position. As shown in FIG. 1, tie members 23 having hooks 22 and 26 can be used in association with chimney 15. The central portion 35 of tie members 23 is usually made of rubber or the like and tie members 23 are usually called "tie-downs" and they are used for tying down loads or the edges of tents or tarpaulins. Alternatively, if desired, string-type of ties can be used, or any other suitable type of member which will attach the free end of chimney 15 to framework 29. The edges 17–20, inclusive, may be secured within the manhole in any number of ways. If there is a conduit, such as 36 running through the manhole, an edge, such as 20, may be draped over the conduit to thus hold this portion of sheet-like member 11 in position. Alternatively, hooks 37 of any conventional type may be driven into manhole wall 39 and tie members 23 may be secured between edge portion 19 and the hooks on wall 39. A tie member 23 may also be positioned between conduit supporting bracket 40 and edge 19, it being understood that oftentimes a plurality of brackets 40 are mounted on manhole wall 39 for supporting cables, such as 30 and 31.

Figure 4:
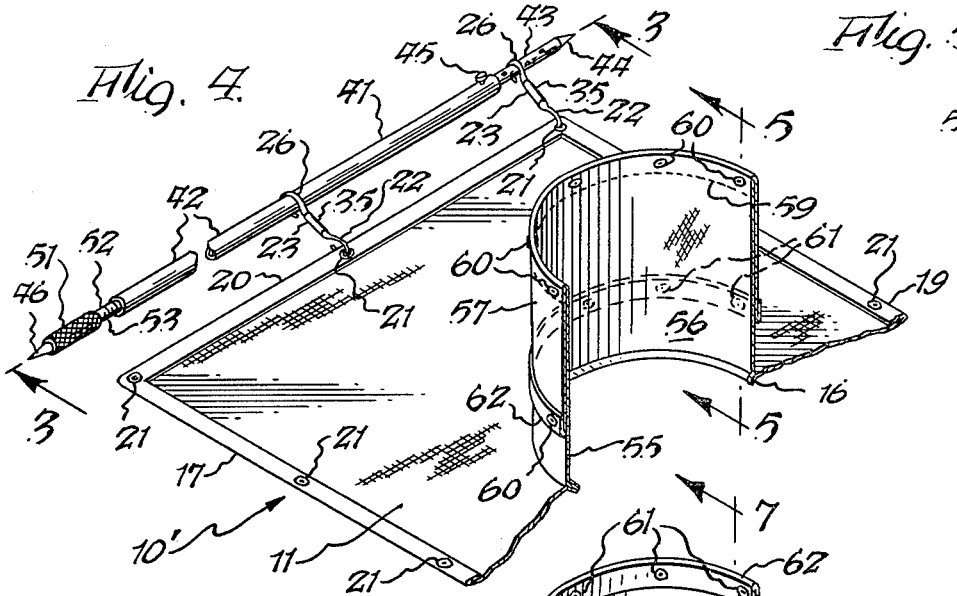
FIG. 4 is a fragmentary view, partly in cross section, showing the manner in which the tent is attached to the expandable bar and also showing an extension to the manhole chimney, with the extension being in nonextended position.
Figure 5:
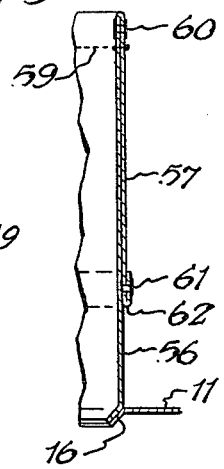
FIG. 5 is a fragmentary cross sectional view taken substantially along line 5—5 of FIG. 4.
Figure 6:
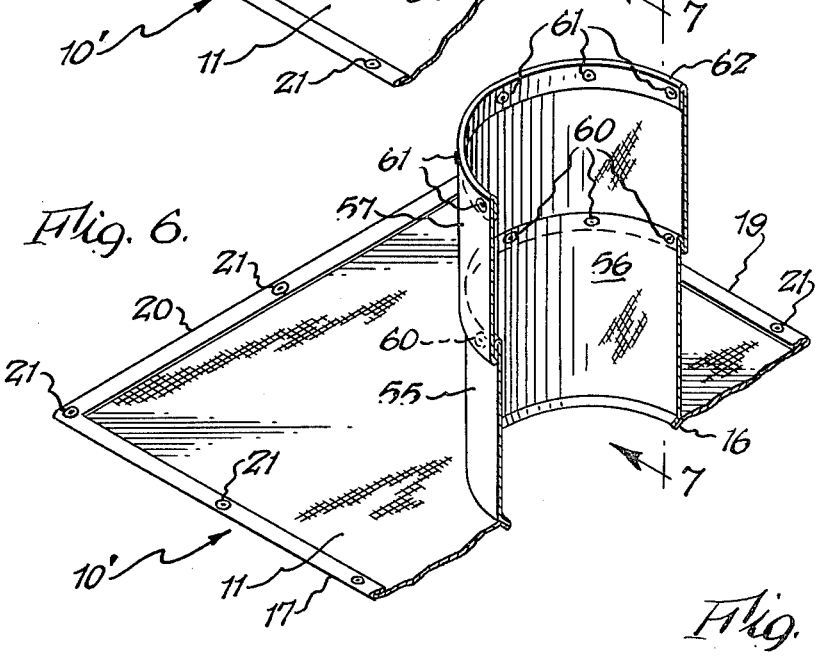
FIG. 6 is a fragmentary view, partially in cross section, similar to FIG. 4 but showing the chimney extension in extended position.
Figure 7:
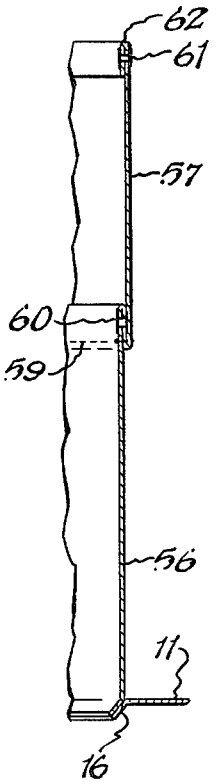
FIG. 7 is a fragmentary cross sectional view taken substantially along line 7—7 of FIG. 6.
Figure 3:
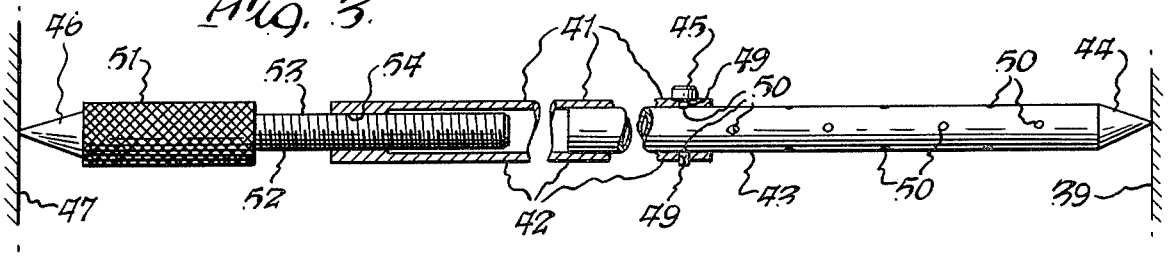
FIG. 3 is a fragmentary cross sectional view of an expandable bar which can be used for securing the tent in position.

Another way of supporting the edge, such as 18, of sheet-like member 11 is by means of an expandable rod or bar 41, such as shown in FIGS. 1, 3 and 4. Rod 41 includes an outer cylindrical hollow portion 42 which receives inner cylindrical portion 43 in telescoping relationship. Member 43 is pointed at its outer end 44 for pressing into manhole wall 39. To install rod 41, pin 45 is removed so that rod 43 can be slid outwardly relative to rod 42 until such time as point 44 engages wall 39 and until point 46 is close to wall 47 which lies opposite to wall 39. Thereafter, pin 45 is inserted through diametrically opposed holes 49 in member 42 and through diametrically aligned holes, such as 50, in member 43. Thereafter, the knurled portion 51 of threaded member 52 is manually grasped and member 52 is turned so that its threaded portion 53 which engages tapped portion 54 causes point 46 to move to the left until it presses into wall 47. Thus, rod 41 will be installed within the manhole, as shown in FIG. 1, and unto which tie members 23 may be mounted as shown in FIG. 1 between rod 41 and the edge 18 of planar member 11. While rod 41 has been shown as having pointed ends, it will be appreciated that the ends may be of any other suitable configuration which will frictionally engage the opposed walls. As an alternate arrangement, if desired, a rod can be suspended from hooks driven into the manhole ceiling.

It will be appreciated that the exact means of attachment for the edges of sheet-like member 11 will depend on the structure of a particular manhole. Thus, if there are conduits such as 36 on opposite sides of the manhole, the opposite edges of sheet-like member 11 can be draped over such conduits, without more. Alternatively, a pair of rod-like members 41 may be installed along opposite walls and onto which the edges of sheet-like member 11 may be installed, as shown in FIG. 1, or, if desired, the edges may be draped over rods 41. Alternatively, if desired, a series of wall hooks, such as 37, may be installed into the manhole walls and tie members, such as 23, may be used to attach various edges of sheet-like member 11 to the walls. If desired, one side of sheet-like member 11 may be installed at a higher elevation than the opposite side to allow for drainage off of the lower side, thereby tending to obviate the collection of liquids on sheet-like member 11.

Figure 2:
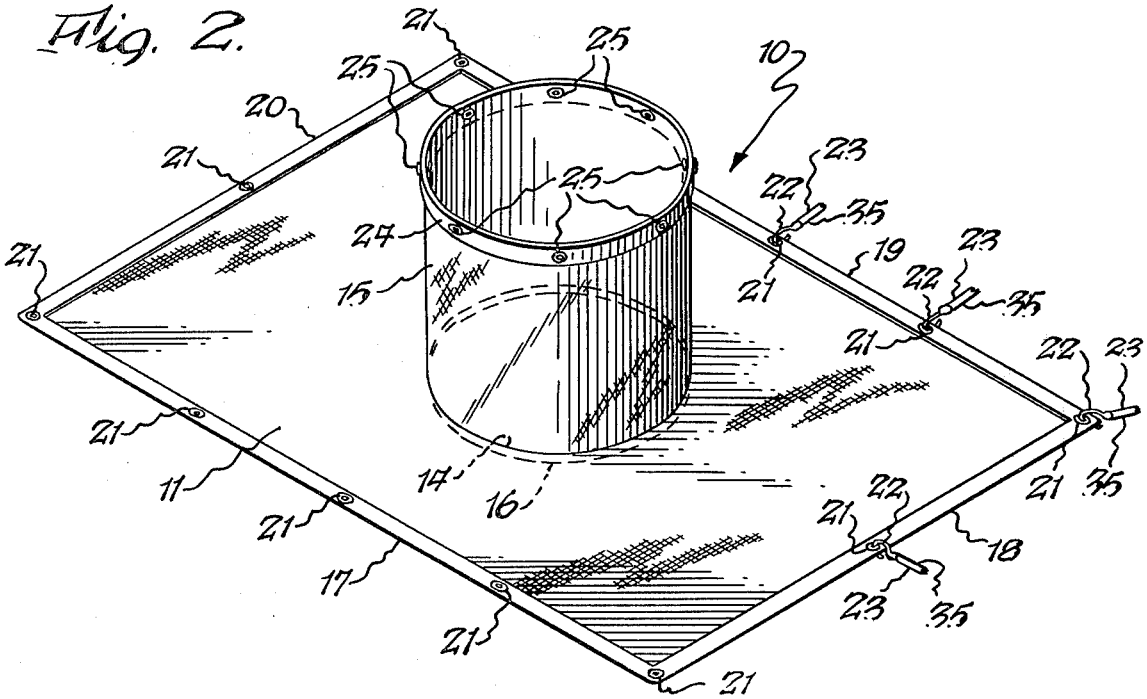
FIG. 2 is a perspective view of the manhole ceiling tent.

In FIGS. 4–7, an alternate embodiment of the present invention is disclosed. The sheet-like member 11 of manhole tent 10' may be identical in all respects to that described above relative to FIG. 2. The only differences in the two constructions is that the construction of FIGS. 4–7 includes an extensible tent chimney to permit tent 10' to be used with manholes having different lengths of chimneys. In this respect, the tent chimney 55 includes a main portion 56 of cylindrical configuration, as shown in FIG. 2. An extension 57 forms a part of main portion 56. As can be seen from FIGS. 4 and 5, extension 57 is fabricated from the same piece of material as main portion 56 but it is folded over onto main portion 56, with a hem between portions 56 and 57 being formed by stitching 59 and a plurality of grommets 60. If a shorter manhole is being used, tie members such as 23 are attached to grommets 60 while extension 57 remains in the folded-over position shown in FIGS. 4 and 5. On the other hand, if the manhole chimney is longer so that it is impractical to use the tent chimney in the folded-over position shown in FIGS. 4 and 5, extension 57 is folded upwardly to the position shown in FIGS. 6 and 7 and the grommets 61 at the upper edge 62 may be used to receive tie members, such as 23.

As noted briefly above, the entire manhole ceiling tent 10 may be fabricated from suitable material, such as canvas, rubberized canvas, rubber types of compounds, or plastics of any suitable sort which will provide the required wear and handleability characteristics. The fabric should be as strong as possible, pliable, lightweight, and as waterproof as possible. The dimensions may be roughly as follows: Sheet-like portion 11 may be approximately 5 feet by 8 feet, and the tent chimney 15 attached thereto may be approximately 3 feet in diameter and of a height of about 2½ feet. The chimney extension 57 may be approximately one foot long. As noted above, while tie members, such as 23, have been shown, it will be understood that any type of fastening devices, such as ropes, strings, or other types of ties, may be used for securing the manhole tent in position.

The above description has disclosed manhole tents having tent chimneys. However, it will be appreciated that under certain circumstances the chimney can be eliminated, and the periphery of the opening in the planar portion can be secured by ties to a frame such as 29 shown in FIG. 1, and such a construction is within the scope of the present invention.

While preferred embodiments of the present invention have been disclosed, it will be understood that the present invention is not limited thereto, but may be otherwise embodied within the scope of the following claims.

What is claimed is:

1. A manhole tent comprising sheet-like means for placement in contiguous relationship to the ceiling of a manhole, and opening means in said sheet-like means for permitting ingress and egress of personnel relative to said manhole.

2. A manhole tent as set forth in claim 1 including attachment means for suspending said manhole tent in said contiguous relationship to said ceiling.

3. A manhole tent as set forth in claim 2 including a tent chimney attached to said sheet-like means leading to said opening means.

4. A manhole tent as set forth in claim 3 including second attachment means for attaching said tent chimney within a manhole chimney.

5. A manhole tent as set forth in claim 4 wherein said attachment means comprises a plurality of grommets at the edges of said sheet-like means and wherein said second attachment means comprises a plurality of grommets at the edge of said tent chimney remote from said sheet-like means.

6. A manhole tent as set forth in claim 4 wherein said attachment means comprises a plurality of tie members.

7. A manhole tent as set forth in claim 3 wherein said tent chimney includes a chimney extension for varying the length of said chimney.

8. A manhole tent as set forth in claim 7 wherein said tent chimney includes first attachment means at the outer end thereof remote from said sheet-like means for securing said tent chimney relative to a manhole chimney, securing means for securing said tent chimney extension proximate said outer end of said tent chimney to permit said chimney extension to lie in contiguous relationship to said tent chimney but to be moved into an extending relationship with respect thereto, and second attachment means on the end of said tent chimney extension remote from said securing means for securing said tent chimney extension relative to a manhole chimney.

9. A manhole tent as set forth in claim 2 wherein said attachment means includes a rod, and mounting means on said rod for mounting said rod proximate said ceiling of said manhole.

10. A manhole tent as set forth in claim 9 including means for expanding said rod.

11. A manhole tent as set forth in claim 10 wherein said mounting means comprise securing means on the ends of said rod for securement on opposite walls of said manhole.

12. A manhole tent as set forth in claim 11 wherein said securing means comprise pointed ends on said rod.

* * * * *